United States Patent [19]

Maeda et al.

[11] Patent Number: 4,555,069

[45] Date of Patent: Nov. 26, 1985

[54] YARN WINDING APPARATUS AND METHOD

[75] Inventors: Yoshiyasu Maeda, Nara; Akira Ueura; Kazuyoshi Sato, both of Kyoto; Katsunori Watanabe, Shiga, all of Japan

[73] Assignee: Murata Kikai Kabushiki Kaisha, Japan

[21] Appl. No.: 438,414

[22] Filed: Nov. 1, 1982

[30] Foreign Application Priority Data

Nov. 2, 1981 [JP] Japan ..... 56-175896
Nov. 2, 1981 [JP] Japan ..... 56-176190
Dec. 2, 1981 [JP] Japan ..... 56-194789

[51] Int. Cl.[4] ..... B65H 54/32

[52] U.S. Cl. ..... 242/43 R; 242/18.1; 242/43.1

[58] Field of Search ..... 242/43 R, 43.1, 18.1

[56] References Cited

U.S. PATENT DOCUMENTS

| | | | |
|---|---|---|---|
| 2,285,439 | 6/1942 | Jones | 242/43 R |
| 2,296,421 | 9/1942 | Campbell | 242/43 R |
| 2,360,909 | 10/1944 | Swanson et al. | 242/43 R |
| 2,705,598 | 4/1955 | Bauer et al. | 242/43 R |
| 3,350,021 | 10/1967 | Marciniak | 242/43.1 X |
| 3,408,014 | 10/1968 | Fisher, Jr. | 242/18.1 X |
| 3,727,855 | 4/1973 | Richter | 242/18.1 |
| 3,730,448 | 5/1973 | Schippers et al. | 242/18.1 X |
| 3,884,426 | 5/1975 | Hermanns | 242/18.1 X |
| 4,006,863 | 2/1977 | Bense | 242/18.1 |
| 4,280,667 | 7/1981 | Akers | 242/18.1 X |

*Primary Examiner*—Stanley N. Gilreath
*Attorney, Agent, or Firm*—Spensley Horn Jubas & Lubitz

[57] ABSTRACT

An improved method and apparatus for winding a yarn on a package are disclosed. The apparatus comprises the package supported on a pair of cradle arms and driven by a friction roller, with a traverse guide disposed between a traverse drum and a cam plate so as to reciprocatingly traverse the yarn from one end of the package to the other. The traverse cam plate is positionally controlled to vary the width of the traverse by an arcuate cam, affixed to the cradle arm, acting on a first pivoting lever connected by a rod to the cam plate such that the width of the traverse is decreased as the package size grows. A second cam, affixed to the cradle arm acts on a second lever during an initial winding period to maintain a pivot axis of the first lever in a fixed position. After disengagement of the second lever from the second cam, the second lever is engaged by a programmably driven third cam to vary the position of the pivot axis of the first lever such that the traverse width may be controllably varied, in addition to the decrease caused by the arcuate cam acting on the first lever, to stagger yarn rises at the edges of the package. The invention further includes the method of using the apparatus.

11 Claims, 29 Drawing Figures

FIG. 4-a
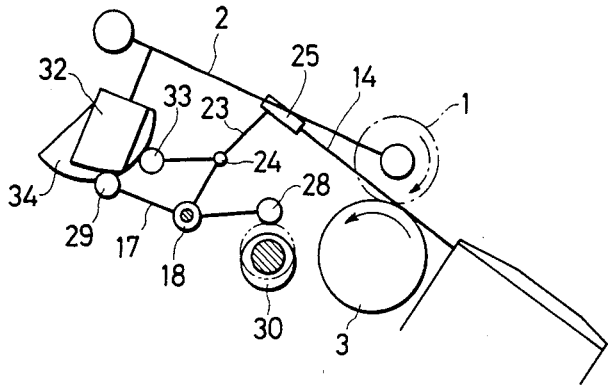
FIG. 4-b
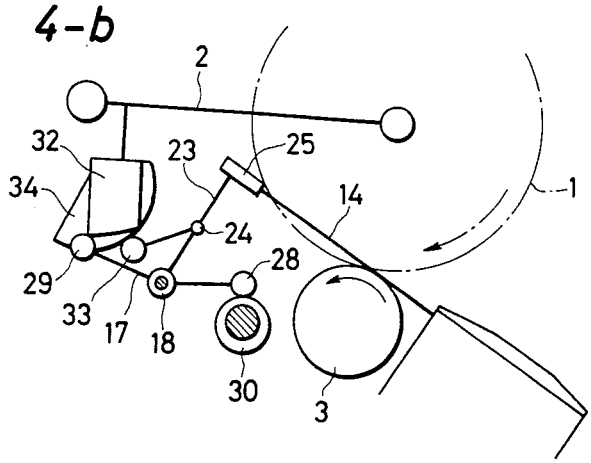
FIG. 4-c
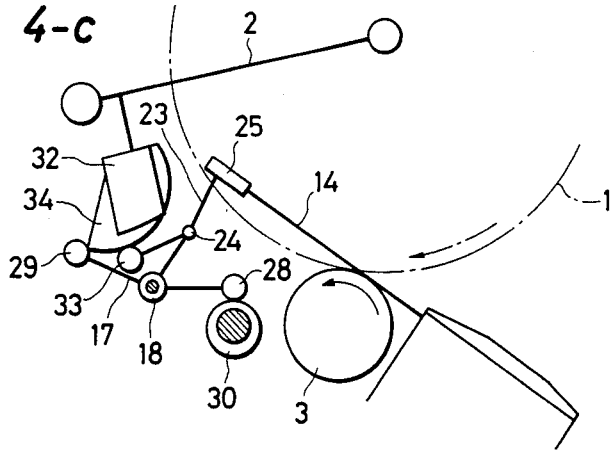

FIG. 8
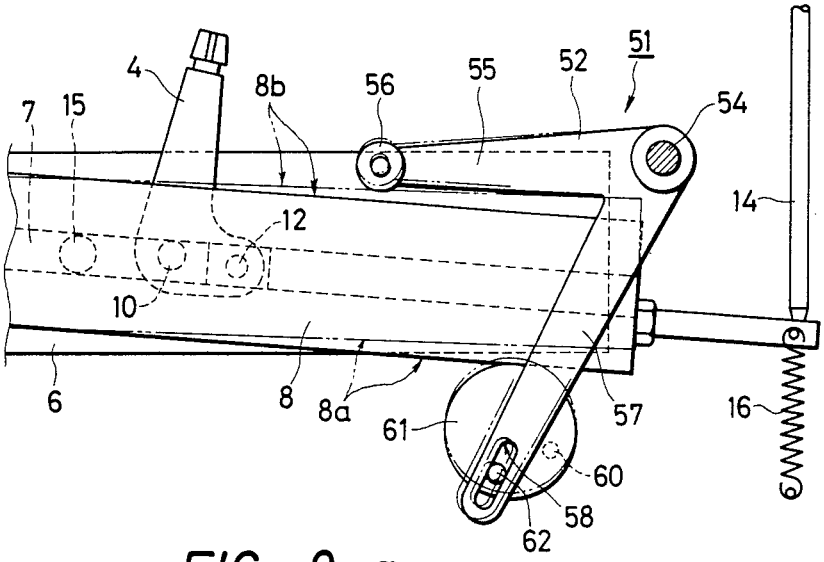
FIG. 9-a
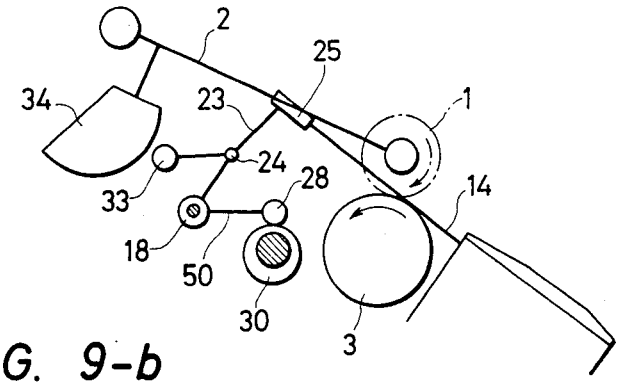
FIG. 9-b
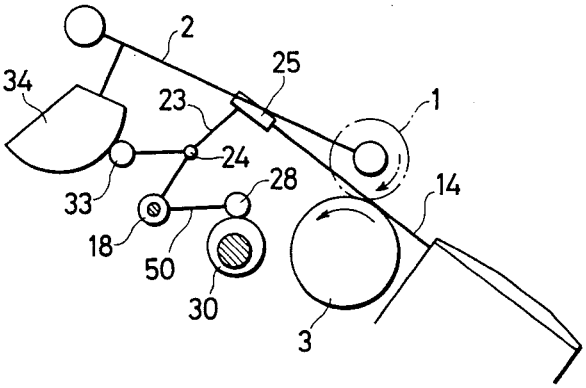

YARN WINDING APPARATUS AND METHOD

FIELD OF THE INVENTION

The present invention relates to a yarn winding method, and more particularly to a method of winding a yarn as supplied at a constant speed on a package as the package is rotated by pressed engagement with a friction roller while traversing and creeping the yarn with a traverse guide.

BACKGROUND OF THE INVENTION

Twisting machines, spun yarn winding machines and the like include a cheese package for winding thereon a yarn supplied continuously at a constant speed. During such winding operation, the package is driven to rotate in pressed contact with a friction roller which rotates at a high speed, and the yarn is traversed laterally by a reciprocating traverse guide interlocked by a traverse drum in a cam box through an axis.

The traverse guide is usually subjected to a motion known as "creeping" to prevent uneven winding, that is, package edge rises while the yarn is being wound on the package.

More specifically, the traverse guide traverses the package through a width reduced by a few mm at repeated intervals at each end of the traverse width, thereby preventing yarn rises at the package edges. However, the above creeping motion has failed to completely eliminate the package edge yarn rises.

As shown in FIG. 1, the effectiveness of creeping with which to prevent yarn rises is known as being dependent on the ratio of the time T in which the traverse guide moves with the maximum traverse width to the time in which the traverse guide moves with a smaller traverse width, that is, a creeping time t.

It is known that as the creeping ratio ($a=t/(T+t)\times 100$) approaches 100%, less yarn rises at package edges are produced and the height of the yarn rises becomes smaller.

Increasing the creeping ratio $\alpha$ in an effort to prevent the yarn rises, however, results in a tendency to give rise to a decrease in the amount of yarn wound at an end of the package, which is known as a yarn shortage, especially when a yarn starts to be wound on a package under high tension.

Further conventional creeping motion is shown in FIG. 10 in which a path $T_1$ is followed by points reached by the traverse guide at an edge of a package in its traversing strokes. This prior creeping motion however results in two yarn rises at the package edge as shown in FIG. 11, one yarn rise being at an end of the maximum traverse width and the other at an end of the minimum traverse width. FIG. 12 shows another creeping motion which has been proposed to remove the foregoing two yarn rises. The repetitive creeping motion of FIG. 12 follows a path $T_2$, but still produces a yarn rise as shown in FIG. 13 which is inherent in such a creeping path.

SUMMARY OF THE INVENTION

An object of the present invention is to provide a novel method of winding a yarn while effectively eliminating yarn rises at the edge of a package.

The present invention provides a method of winding a yarn on a package in a twisting machine, a spun yarn winding machine, or the like, at an optimum creeping ratio as the yarn is in the process of being wound on the package.

While, it has been noticed that the location or locations where yarn rises are created vary with different creeping paths, and has been found that yarn rises due to creeping motions can be offset by each other by changing each path of a multiplicity of creeping motions during the yarn winding process.

Moreover, effecting creeping suitable for a yarn being wound is also accomplished by a method in which a plurality of intervals of time in which a traverse guide can stop in a maximum traverse width are predetermined, and such plurality of traverse time intervals are successively selected while a package is being wound up to change the traverse time successively in the maximum traverse width.

BRIEF DESCRIPTION OF THE DRAWINGS

FIGS. 4-*a* through 5-*c* are a set of schematic diagram illustrative of operations of the apparatus of FIG. 2;

FIG. 8 is a view taken along line VIII—VIII of FIG. 7;

FIGS. 9-*a* and 9-*b* are a set of schematic diagrams showing operations of the apparatus of FIG. 7;

DETAILED DESCRIPTION OF THE INVENTION

Figure 1:
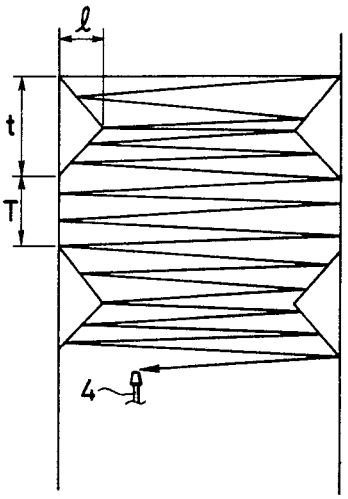
FIG. 1 PRIOR ART
FIG. 1 is a diagram showing normal traversing and creeping motions of a traverse guide.

Apparatus for reducing one embodiment of a method of the invention to practice will now be described.

FIGS. 2 through 6 show an apparatus according to a first embodiment of the invention. The apparatus includes a package 1 supported at its ends by cradle arms 2 and pressed against a friction roller 3, and a traverse guide 4 sandwiched between a traverse drum 6 having in its outer circumference a traverse groove 5 and a cam plate 8 having in its inner surface a longitudinal groove 7. The traverse guide 4 is of an L shape having on its curved corner a shaft 10 fitted in the traverse groove 5 and on one arm 11 a shaft 12 received in the groove 7. The width or interval that the traverse arm 4 can traverse can be increased or reduced by a swinging movement of the cam plate 8.

More specifically, when the cam plate 8 is angularly moved in the direction of the arrow X (FIG. 3) by a traverse-width changer 13 through a rod 14, the width that the distal end of the traverse guide 4 reciprocably moves becomes reduced. When the cam plate 8 is angularly moved in a direction opposite to that of the arrow X, the width that the traverse guide 4 traverses is increased. The cam plate 8 is angularly moved about a pivot 15 aligned with the center of the cam plate 8. The cam plate 8 is normally urged by a spring 16 to move in the direction opposite to that of the arrow X.

The traverse-width changer 13 will be described below.

A substantially y-shaped arm 17 is rotatably supported on a shaft 18 mounted on a machine frame (not shown) and includes an arm member 20 having an end to which there is rotatably supported by a pin 24 an angular arm 23 having two arm members 21, 22. A rod 14 for pulling the cam plate 8 is coupled at 25 to an end of the arm member 21 of the angular arm 23.

Figure 2:
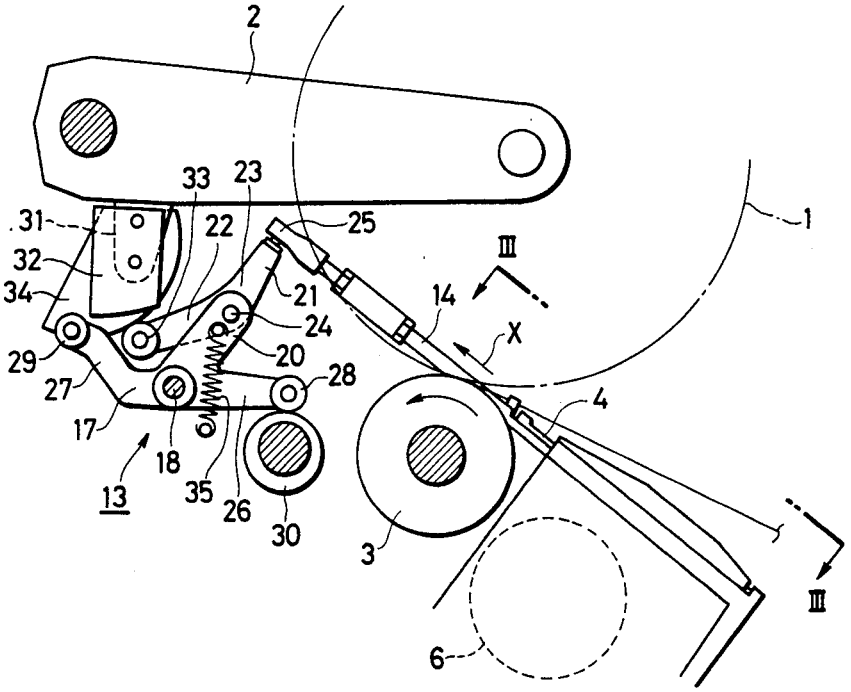
FIG. 2 is a side elevational view of a yarn winding device for reducing one embodiment of a method of the invention to practice.

Cam rollers 28, 29 are attached respectively to the other two arm members 26, 27 of the y-shaped arm 17. The cam roller 28 is held in contact with an eccentric cam 30 supported by the machine frame and rotatable slowly under a predetermined program by a drive unit (not shown). The cam roller 29 is engageable with a plate cam 32 mounted by a bracket 31 on one of the cradle arms 2. The arm member 22 of the angular arm 23 has a cam roller 33 held in engagement with a cam 34 in the shape of one-third of a circle mounted by the bracket 31 on the cradle arm 2. A spring 35 is coupled between a pin attached to the machine frame and a pin fixed to the y-shaped arm 17 for normally urging the y-shaped arm 17 turn clockwise as shown in FIG. 2.

Operation of the apparatus thus constructed will be described with reference to FIGS. 4 and 5.

As described above, the width that traverse guide 4 reciprocably moves, that is, the traverse width, becomes reduced when the cam plate 8 is turned in the direction of the arrow X (FIG. 3) by the traverse-width changer 13 or the rod 14 is pulled, and becomes reduced when the cam plate 8 is turned in the opposite direction, or the rod 14 is pushed back. At the starting of winding the package 1 (FIG. 4-a), the cam roller 33 is held against a proximal end portion of the arcuate cam 34 and the rod 14 is pushed bck due to clockwise rotation of the angular arm 23 about the shaft 24, resulting in a maximum traverse width (FIG. 4-a). As the package 1 grows, the cradle arms 2 angularly moves upwardly until the cam roller 33 reaches a distal end portion of the arcuate cam 34, whereupon the angular arm 23 slowly turns counterclockwise about the shaft 24, thereby pulling the rod 14 (FIG. 4-c) to progressively reduce the traverse width.

Figure 5:
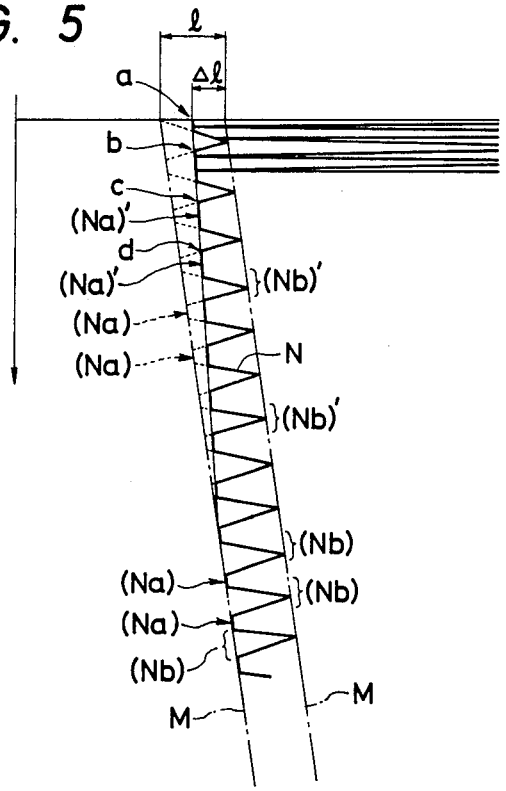
FIG. 5 is a diagram illustrative of traversing and creeping motions according to a method of winding a yarn of the present invention.
Figure 6:
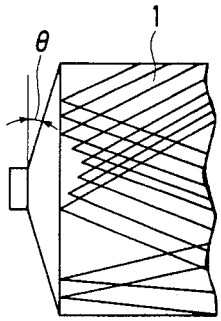
FIG. 6 is a schematic view of a package that has been wound.

The traverse width is slowly reduced by the interaction of the cam 34 and the cam roller 33 in a pattern which is indicated by two parallel dot-and-dash lines M in FIG. 5 which is a diagram showing changes in the traverse width with time. Such a reduction in the traverse width results in a taper ($\theta$) (FIG. 6) at each end of the package 1. In addition to progressive reduction of the traverse width for the formation of such a taper, the eccentric cam 30 and the cam roller 28 interact as follows:

While the angular arm 23 turns slowly clockwise about the shaft 24 as the package 1 grows throughout the full stroke for winding the yarn, the shaft 24 is subjected to a rocking movement in small periods of time due to rotation of the eccentric cam 30. Accordingly, the rod 14 is moved back and forth in small periods to allow the traverse width to undergo creeping within an interval or width l in short periods dependent on the eccentricity of the eccentric cam 30. The creeping is indicated by a zigzag line N between the two parallel lines M in FIG. 5.

The zigzag line N includes straight portions Na at a lefthand traverse return edge in FIG. 5, which are indicative of the maximum-width traverse motion similar to the interval T with the full traverse width as shown in FIG. 1. The ratio of the portions Na with the maximum-width traverse motion to portions Nb with a creeping motion can be selected as desired under a program for moving the eccentric cam 30. In the illustrated apparatus, however, such a ratio of creeping is not determined by changing the program for moving the eccentric cam 30, but is reduced when the package 1 starts to be wound and then progressively increased as the package diameter becomes larger.

More specifically, when the package 1 starts being wound, the plate cam 32 mounted on the cradle arm 2 is held against the cam roller 29 on the y-shaped arm 17 (FIG. 4-a) to prevent the latter from being turned clockwise in a direction to increase the traverse width beyound a certain position. This substantially reduces the eccentricity of the eccentric cam 30 to an amount $\Delta l$ (FIG. 5) at the starting of yarn winding.

During an angular interval in which the y-shaped arm 17 is prevented by the plate cam 32 from turning clockwise, the y-shaped arm 17 is not actuated by the eccentric cam 30 and remains inactive against swinging movement for a certain period of time (FIG. 4-a). Stated otherwise, while the eccentric cam 30 rotates in constant periods under a predetermined program, at the starting of yarn winding, the y-shaped arm 17 is caused by the plate cam 32 to move the traverse guide 4 along a zigzag pattern N shown by the solid line (FIG. 5) having maximum-width traverse portions Na' that have been displaced from the portions Na as illustrated by the dotted lines. The creeping ratio ($\alpha = Nb'/(Na + Nb') \times 100$) is rendered substantially smaller as Na<Na' and Nb>Nb'. The amount of creeping is also reduced to Δl.

As the package 1 grows and the plate cam 32 disengages from the cam roller 29 in response to angular movement of the cradle arms 2 (FIGS. 4-*b*, 4-*c*), the y-shaped arm 17 and the angular arm 23 are actuated only by the interaction between the cam roller 28 and the eccentric cam 30 and between the cam roller 33 and the arcuate cam 34 to provide a creeping amount due to the cam eccentricity l and an increased creeping ratio ($\alpha = Nb/(Na+Nb) \times 100$) according to the program for moving the eccentric cam 30.

An apparatus according to a second embodiment will be described with reference to FIGS. 6 through 9.

Figure 3:
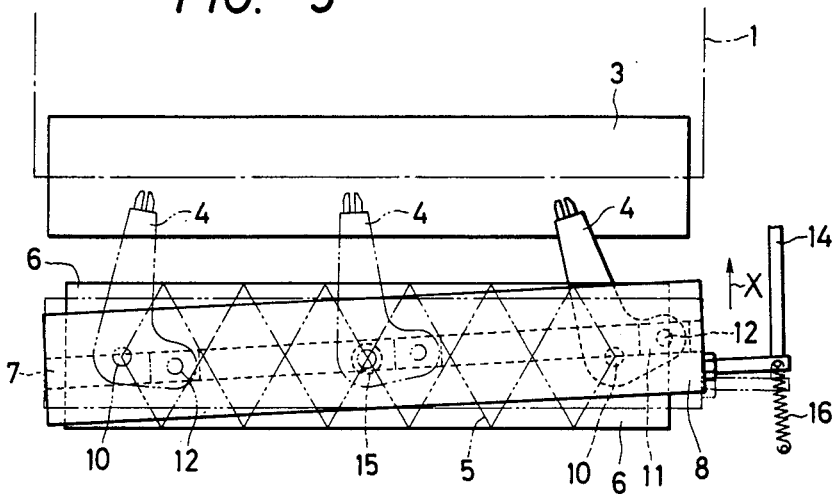
FIG. 3 is a view taken along line III—III with a cover of a traverse unit removed.
Figure 7:
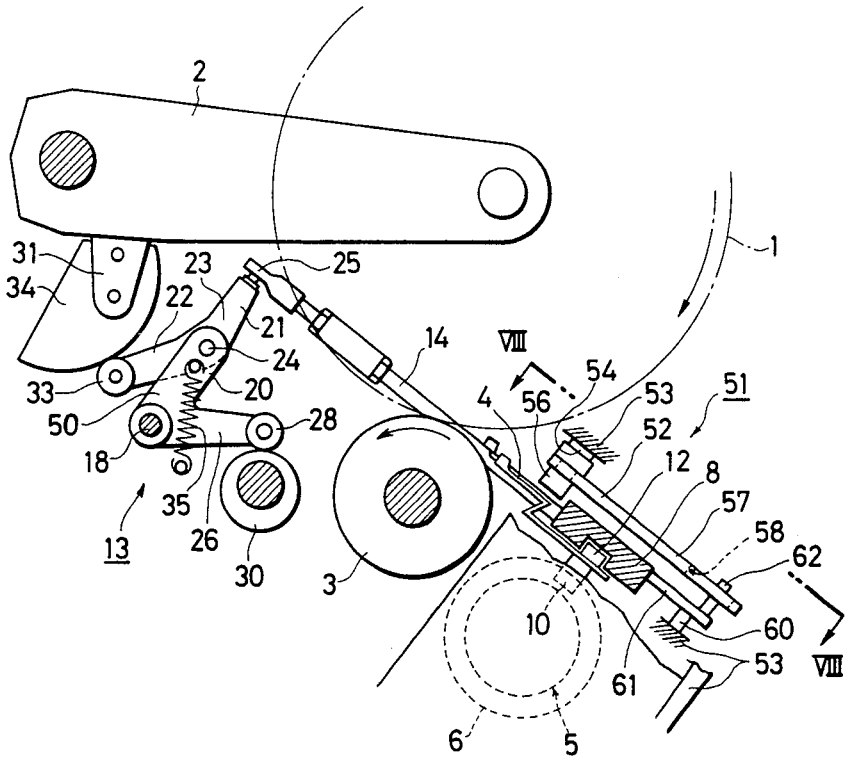
FIG. 7 is a side elevational view of an apparatus according to another embodiment of the present invention.

Like or corresponding parts in FIGS. 7 and 8 are denoted by like or corresponding reference characters shown in FIGS. 2 through 4, and their description will be omitted. With the second embodiment, the y-shaped arm 17 of the traverse-width changer 13 illustrated in FIG. 2 is replaced with a V-shaped arm 50, and the plate cam 32 is dispensed with but only the cam 34 shaped as one-third of a circle is attached to the cradle arm 2 for forming a taper at each end of a package 1. The apparatus according to the second embodiment includes a displacement stopper device 51 mounted on the cam plate 8 for the traverse guide 4.

The displacement stopper device 51 comprises a bell crank 52 rotatably supported by a shaft 54 to a housing 53 of a traverse unit. The bell crank 52 has an arm 55 on which a roller 56 is mounted and an arm 57 having an oblong hole 58 in a distal end thereof. A stopper cam 61 is disposed below the oblong hole 58 and behind the cam plate 8, the stopper cam 61 being rotatably mounted on the housing 53 by an eccentric pin 60. The stopper cam 61 has a pin 62 projecting from an upper surface thereof into the oblong hole 58.

The traverse-width changer 13 can change the traverse width due to interaction between the arcuate cam 34 and the cam roller and between the eccentric cam 30 and the cam roller 28 in a manner as described above, but has no interaction between the plate cam 32 and the cam roller 29 as with the preceding embodiment. The traverse width can be changed by the traverse-width changer 13 according to the second embodiment in a pattern indicated by the zigzag line N (FIG. 5) including the dotted lines between the two parallel dot-and-dash lines M.

The displacement stopper device 51 according to the second embodiment serves to lower the creeping ratio at the starting of yarn winding like the first embodiment. Therefore, the zigzag pattern in which the traverse width varies is reduced transversely by the displacement stopper device 51 in maximum-width traverse portions to remove the dotted-line portions (FIG. 5) when the yarn starts being wound on the package, with the results that the creeping ratio is smaller at the time of starting yarn winding and becomes progressively greater as the traverse width changes in the zigzag solid-line pattern.

FIG. 8 shows, the solid-line position, the cam plate 8 as having turned clockwise about the shaft 15 when the package 1 starts being wound. In this position, the stopper cam 61 is held against a rear face 8*a* of the cam plate 8 to prevent the cam plate 8 from being further angularly moved clockwise, and the angular arm 23 remains at rest in the position as illustrated in FIG. 9-*a* even when the eccentric cam 30 rotates to turn the V-shaped arm 50 clockwise as shown in FIGS. 7 and 9-*a*. The cam roller 33 is spaced from the arcuate cam 34 by a distance (l−Δl, in FIG. 5) by which the traverse width is reduced transversely at the point a in FIG. 5.

As the eccentric cam 30 rotates to the position shown in FIG. 9-*b*, the shaft 24 is moved to bring the cam roller 33 into engagement with the arcuate cam 34, pulling the rod 14 to swing the cam plate 8 counterclockwise to the dot-and-dash-line position as shown in FIG. 8, in which a front face 8*b* of the cam plate 8 pushes the arm 55 of the bell crank 52 until the stopper cam 61 angularly moves slightly about the eccentric pin 60 to the dot-and-dash-line position of FIG. 8 to thereby displace a point of engagement on the stopper cam 61 toward the cam plate 8.

When the cam plate 8 is turned clockwise again in response to rotation of the eccentric cam 30, the cam plate 8 is stopped by the stopper cam 61 in a position which has been slightly advanced at the point b in FIG. 5.

The cam plate 8 after having turned clockwise is stopped by the displacement stopper device 51 in successively advanced positions a, b, c, d . . . . After the package 1 has sufficiently grown, the cam plate 8 is displaced into a zone in which the stopper cam 61 fails to act, and the stopper cam 61 is caused by the bell crank 52 to make substantially one revolution to have its point of engagement retracted. The displacement stopper device 51 no longer acts on the cam plate 8. The traverse width is now changed only by the action of the traverse-width changer 13 to allow the traverse guide to follow a zigzag pattern having a constant creeping ration and a constant creeping amount.

With the method of this embodiment of the present invention, as is apparent from the foregoing description of the apparatus of the embodiments of the invention, the creeping ratio when the package starts being wound is substantially small and becomes greater thereafter as the package grows. A resultant completed package is free from any yarn rises at its edges and also from yarn shortages.

The creeping ratio in the apparatus according to the foregoing two embodiments is controlled in response to an amount of displacement related to a package being wound (that is, the angle of inclination of the cradle arms and the position of the cam plate) rather than by the eccentric cam. Accordingly, it is not necessary to change the program for moving the eccentric cam 30 for each package. This arrangement is highly advantageous in that it allows the method of the invention to be easily and effectively employed for apparatus in which a multiplicity of package winding devices are arranged in an array and creeping is effected respectively for the package winding devices by a multiplicity of eccentric cams fitted over a single shaft.

Another embodiment of the present invention will now be described with reference to the drawings. FIGS. 14 through 17 illustrate a yarn winding apparatus for reducing a method of the invention to practice. The apparatus includes a plurality of cams 101 which are as many as there are packages and are supported on a cam shaft 102, each cam having a minimum-radius portion extending through an angle $\theta$ (60 degrees in the illustrated embodiment). An L-shaped arm 104 is swingably supported on a shaft 103 and urged by a spring 105 in a direction to press a cam roller 106 on a first arm member 104*a* against each of the cams 101. The L-shaped arm 104 includes a second arm member 104*b* having an end to which there is pivotably supported one end of a rod 107, the other end of which is coupled to an end of a cam plate 109 swingable about a pivot U in a traverse unit 108. The cam 101, the L-shaped arm 104, the rod 107, and the cam plate 109 jointly constitute a device S for changing a traverse width. The cam plate 109 is positioned upwardly of a traverse drum 110 and has a longitudinal groove 111. The traverse drum 110 has a traverse groove 112 in which there is fitted a cam shoe (not shown) supporting L-shaped traverse guides 113, each having on an arm thereof a slide 114 fitted in the groove 111 in the cam plate 109. When the cam plate 109 swings about the pivot U, the length of a laterally reciprocating stroke is increased or reduced. Designated at 115 is a friction roller and P designates a yarn takeup package.

Figure 16:
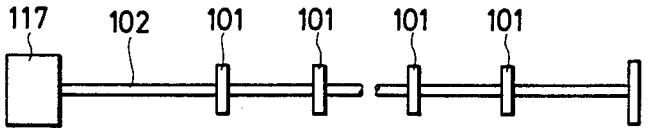
FIG. 16 is a schematic view of cams and a stepping motor as coupled together in accordance with the present invention.

As illustrated in FIG. 16, the cam shaft 102 on which the cams 101 are supported is drivable by a stepping motor 117 which is rotatable through a predetermined angle in a predetermined interval of time by pulses generated by a control unit, described below.

Figure 17:
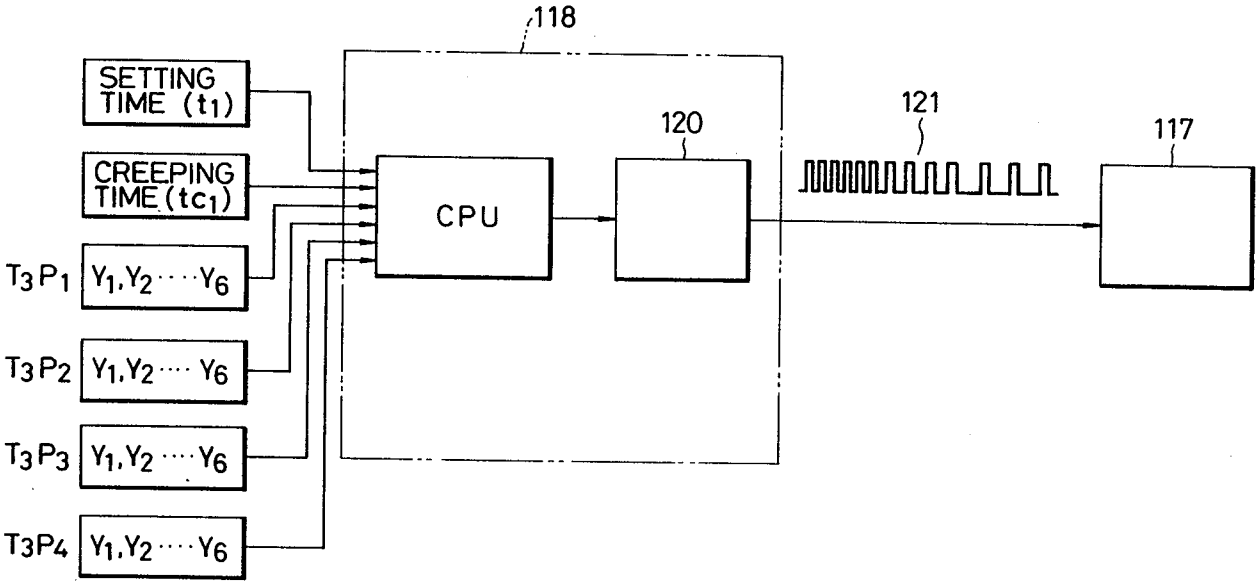
FIG. 17 is a block diagram of a control unit for the stepping motor in accordance with the present invention.

As shown in FIG. 17, a control unit 118 is composed of an arithmetic unit CPU and a pulse generator 120. The arithmetic unit CPU is responsive to supplied data for producing a processed signal which controls the pulse generator 120 to issue a given number of pulses 121 to the stepping motor 117.

When the stepping motor 117 is driven by a number of pulses delivered to rotate through a predetermined angle for a predetermined interval of time, the cams 101 are rotated to cause the L-shaped arms 104 to swing, whereupon the cam plate 109 is turned about the pivot U. Thus, the traverse guide 113 moves an increased or reduced traverse width or interval, thus effecting creeping. In the illustrated embodiment, the traverse guide 113 effects a creeping motion along a path $T_3$ as shown in FIG. 18.

Figure 18:
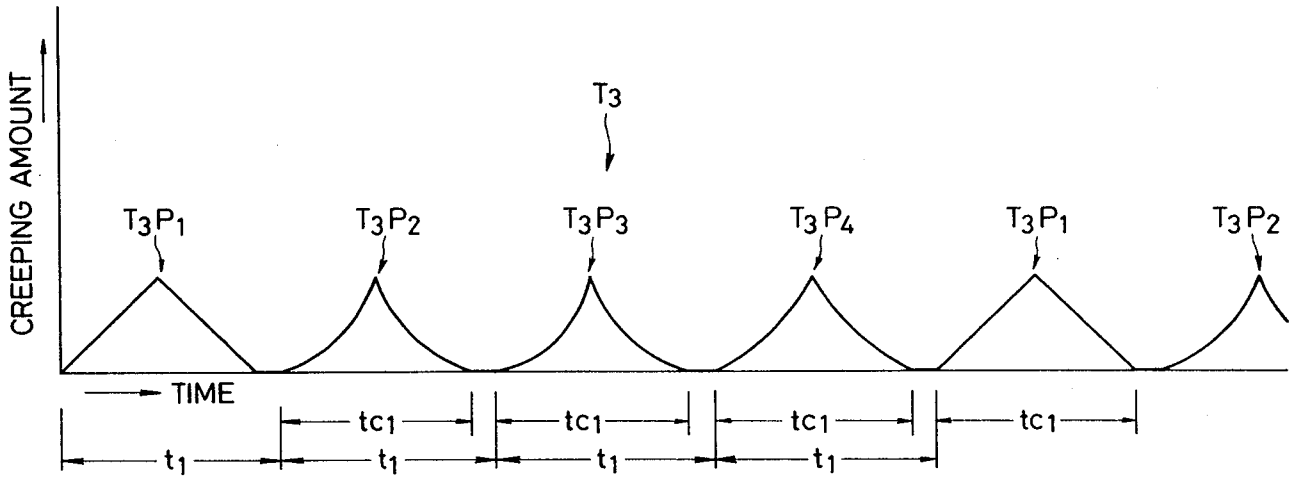
FIG. 18 is a diagram showing a creeping motion according to the present invention.

In FIG. 18, the ratio of creeping is 90%, and the traverse guide returns at each end of the traverse groove 112 in the traverse drum 110 at 90 degrees, resulting in good package formation. The creeping path $T_3$ is composed of a cyclic repetition of four patterns $T_3P_1$, $T_3P_2$, $T_3P_3$, $T_3P_4$ under the control as described below.

Figure 19:
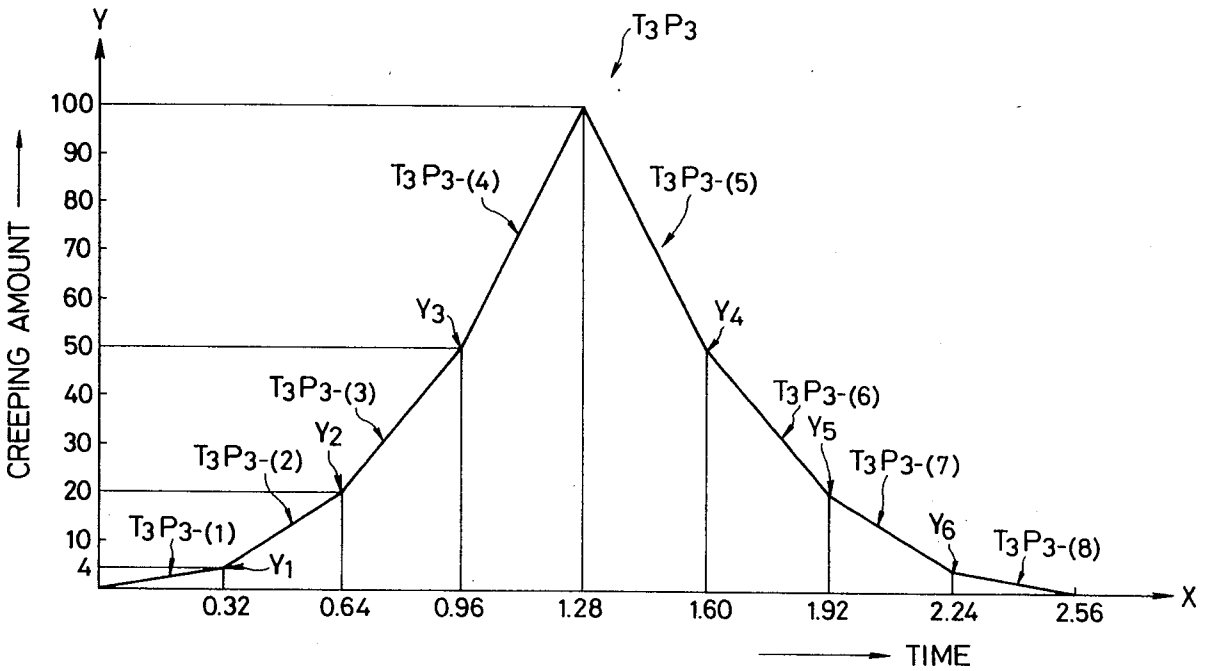
FIG. 19 is an enlarged diagram showing a third creeping pattern in the creeping motion illustrated in FIG. 18.

It is now assumed that the cam 101 has a different-radius cam surface ABC extending through an angle of 300 degrees and the stepping motor 117 rotates through an angle of 0.3 degree per pulse, that is, the stepping motor 117 makes one revolution when supplied with 1,200 pulses. Where it is desired to obtain the third path pattern $T_3P_3$ as shown in FIG. 19 at an enlarged scale under such a condition, the number of pulses necessary to rotate the stepping motor 117 through an angle of 150 degrees, that is, to creep the traverse guide through a forward creeping stroke from 0 to 100 on the Y-axis, is $150 \div 0.3 = 500$. 500 out of the remaining 700 pulses are required by a rearward creeping stroke, and 200 pulses correspond to the maximum traverse width. The stepping motor 117 is supplied with $500 \times 4/100 = 20$ pulses for 0.32 sec. during the period $T_3P_3-(1)_1$, with $500 \times (20-4)/100 = 80$ pulses for 0.32 sec. from 0.32 to 0.64 sec. during the period of $T_3P_3-(2)$, with $500 \times (50-20)/100 = 150$ pulses for 0.32 sec. during the period of $T_3P_3-(3)$, and with $500 \times (100-50)/100 = 250$ pulses for 0.32 sec. during the period of $T_3P_3-(4)$.

In the stroke in which the traverse width increases, or a latter half portion of the creeping motion, the stepping motor 117 is supplied with 250 pulses during the period of $T_3P_3-(5)$, with 150 pulses during the period of $T_3P_3-(6)$, with 80 pulses during the period of $T_3P_3-(7)$, and with 20 pulses during the period of $T_3P_3-(8)$.

Likewise, when the first path pattern $T_3P_1$ as shown in FIG. 18 is desired, the stepping motor 117 should be supplied with 125 pulses during each period. For the other path patterns $T_3P_2$, $T_3P_4$, the stepping motor 117 should be supplied with a different number of pulses in each period from that for the pattern $T_3P_3$.

Figure 20:
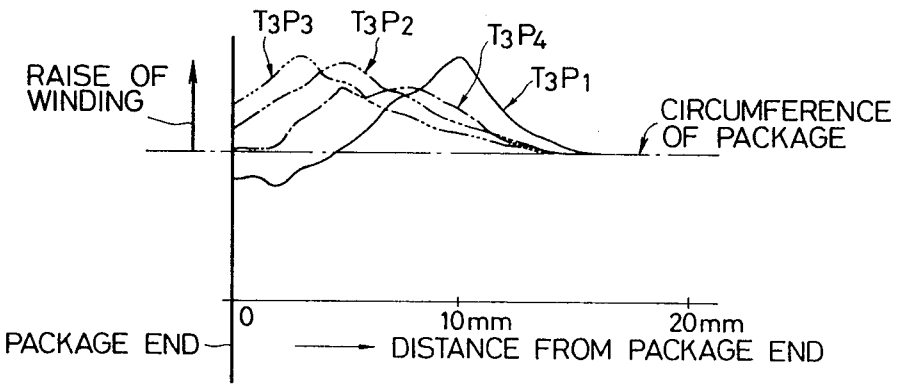
FIG. 20 is a graph showing the manner in which uneven yarn rises of winding are produced on an edge of a package respectively by creeping patterns.

To produce a required number of pulses for the above path patterns, the arithmetic unit CPU is supplied, as shown in FIG. 17, with data on a preset time $t_1$ which is required for one cycle including a single creeping motion and a single maximum traverse width motion, data on a creeping time $tc_1$, and values on the Y-axis ($Y_1$, $Y_2$, $Y_3 \ldots Y_6$) in each period for each creeping path pattern (for example, $Y_1=4$, $Y_2=20$, $Y_3=50$, $Y_4=50$, $Y_5=20$, $Y_6=4$ for the third path pattern $T_3P_3$ in FIG. 19). The arithmetic unit CPU then process the pulses supplied and enables the pulse generator 120 to issue the pulses 121 successively in repeated patterns under a predetermined program, for thereby causing the traverse guide 113 to repeat the four path patterns as shown in FIG. 18 for a desired traverse motion. The foregoing four patterns are selected according to the present invention as follows:

The patterns are established such that yarn rides which would be produced on a package if a yarn were wound thereon by repeating the four patterns of motion independently, will be positioned in staggered relation and offset by each other. The yarn rises would be produced as shown in FIG. 20 if the four patterns were independently repeated. More specifically, the yarn rises due to the patterns $T_3P_1$, $T_3P_2$, $T_3P_3$ are arranged in the order named toward the edge of the package, and staggered with respect to one another.

The yarn rises as shown in FIG. 20 are not actually detected, but simulated by a computer. They can actually be measured by winding a yarn on the patterns.

Five or more patterns may similarly be repeated to perform a desired creeping motion, in which such patterns are differently combined.

Figure 21:
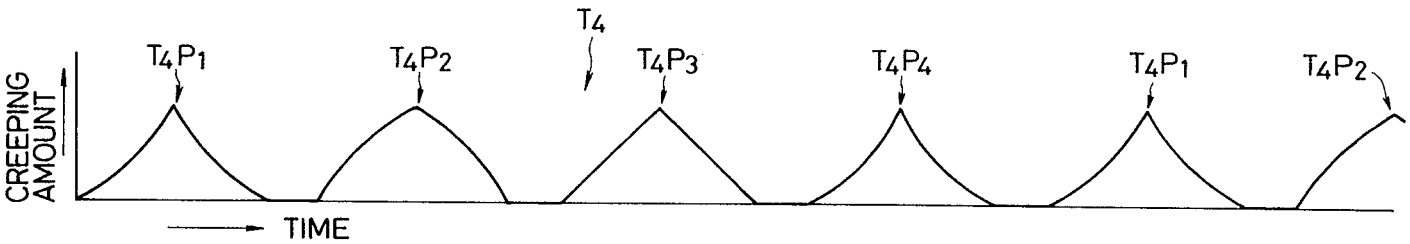
FIGS. 21, 22 and 23 are diagrams illustrative of creeping motions according to other embodiments of the present invention.
Figure 22:
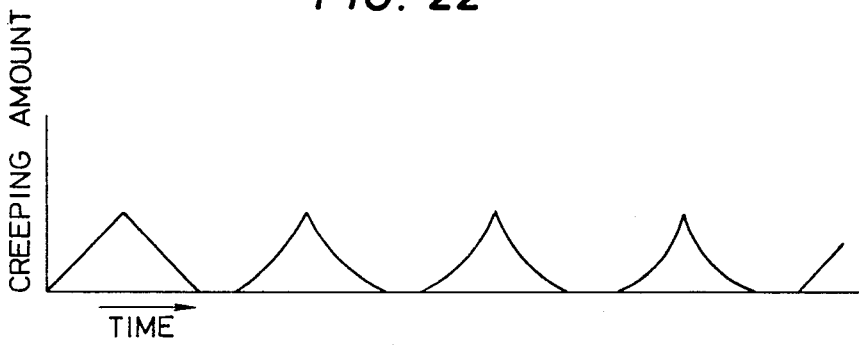
Figure 23:
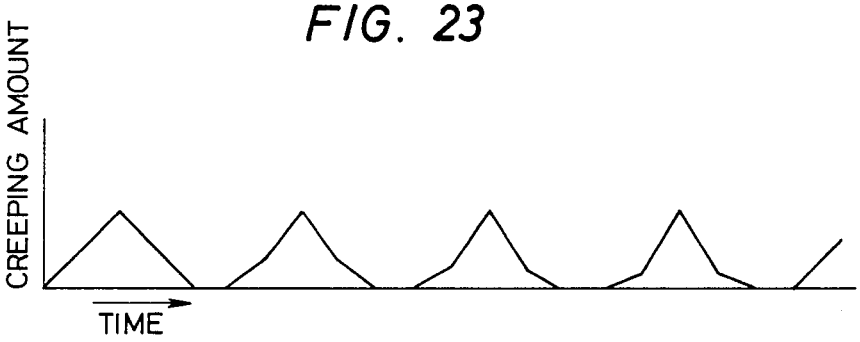
Figure 24:
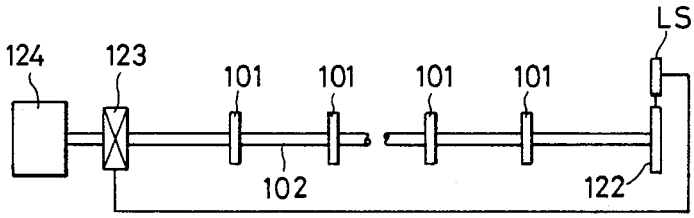
FIG. 24 is a schematic front elevational view of a cam shaft in the traverse unit of an embodiment of the present invention.

The patterns may not necessarily be repeated cyclically, but may be repeated acyclically or randomly. FIG. 21 is illustrative of a creeping path $T_4$ according to another embodiment. The creeping path $T_4$ has a tendency for the amount of yarn wound at an end of a package to be reduced resulting in a yarn shortage under the influence of the second pattern $T_4P_2$. This can be prevented by lowering the creeping ratio to 80% or below to increase the maximum-width traverse interval.

Where set points on the Y-axis are increased on the creeping path as shown in FIG. 22, the speed along each creeping path pattern changes smoothly. Where only two set points are established due to limitations on the capacity of the arithmetic unit CPU and the other parts and for a simplified construction, the creeping path can be drawn as illustrated in FIG. 23. In both embodiments, the creeping paths are selected such that the yarn rises which would be created if each creeping path pattern were repeated independently will be staggered from and offset by each other.

Figure 10:
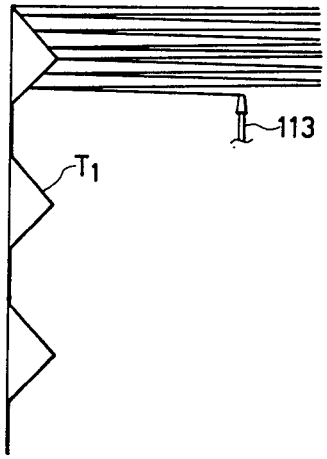
FIG. 10 PRIOR ART
FIGS. 10 and 12 are diagrams of conventional creeping motions.
Figure 12:
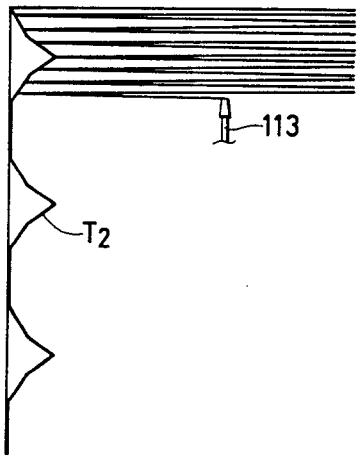
FIG. 12 PRIOR ART
Figure 11:
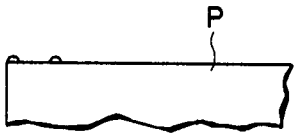
FIG. 11 PRIOR ART
FIGS. 11 and 13 are schematic views illustrative of uneven edges of packages produced while winding yarns through the conventional creeping motions of FIGS. 10 and 11, respectively.
Figure 13:
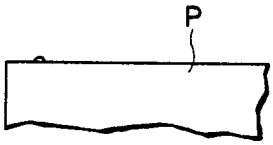
FIG. 13 PRIOR ART

With the yarn winding methods of this embodiment, the creeping motion has at least one point where the speed of creeping changes other than the creeping path return point, that is, the creeping motion does not have simple triangular patterns each composed of two straight lines as shown in FIG. 10. As shown in FIG. 18, the creeping motion of the invention includes creeping motion patterns having different creeping speeds (the entire creeping motion may be composed solely of such creeping motion patterns having different creeping speeds), and the rate of change of the creeping speed differs from creeping pattern to creeping pattern, that is, creeping patterns slightly differ from each other. Such different creeping motion patterns are selected such that yarn rises which would be produced if the creeping motion patterns were independently followed in yarn winding operation will be staggered from and offset by each other on a completed package, resulting in flat edges thereof.

While in the illustrated embodiments the creeping patterns are symmetrical on the strokes in which the traverse interval is increased and reduced, the creeping patterns may be asymmetrical and such different creeping patterns can be realized by supplying the arithmetic unit CPU with different preset times, creeping times, and values at set points on the Y-axis for the creeping patterns. Dependent on the nature of a yarn to be wound, the creeping ratio, or the angle at which the traverse guide returns in the traverse groove, optimum creeping patterns can be determined for reducing generation of yarn rises as much as possible and hence for producing a better package having flat edges.

Still another embodiments of the present invention will be described referring FIGS. 14, 15, 24, 25 and 26.

The cam shaft 102 has a switch cam 122 having a contour such that it will close the contacts of a switch LS when the minimum-radius portion 1*a* of the cam 101 is in contact with the cam roller 106. The switch LS serves to actuate a clutch 123 mounted on the cam shaft 2. When the switch LS is turned on, the clutch 123 is actuated to prevent rotative power from being transmitted from a motor 124 to the cam shaft 102.

A method according to the present invention will now be described.

Figure 14:
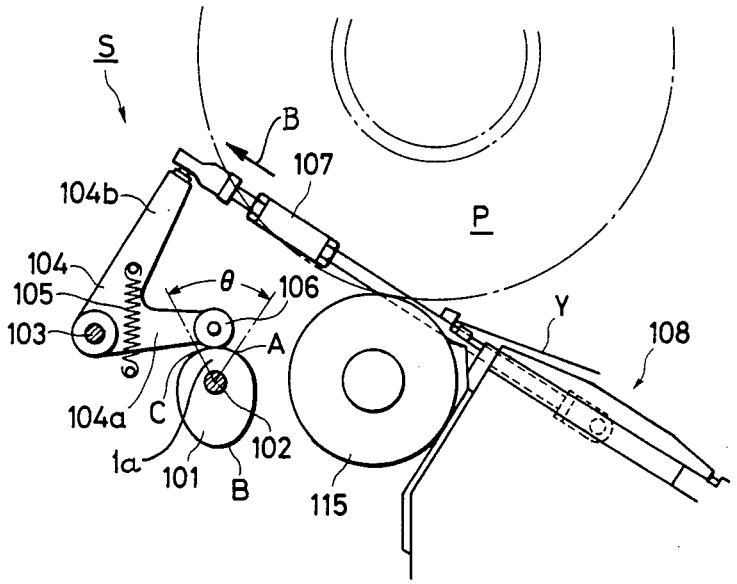
FIG. 14 is a side elevational view of a yarn winding area of a yarn winding apparatus for effecting another embodiment of a method of the present invention.
Figure 15:
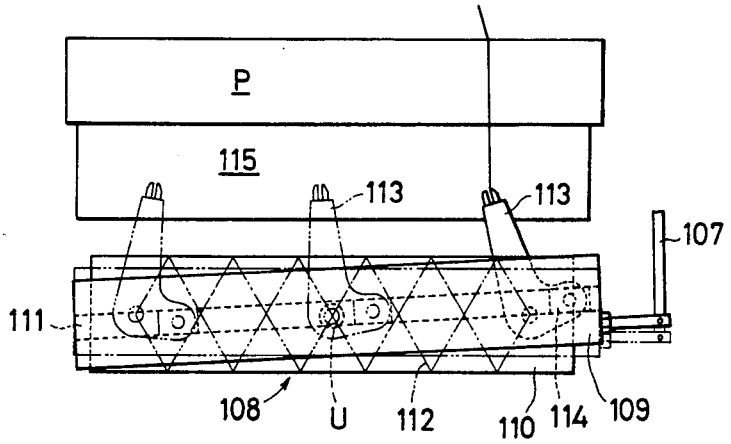
FIG. 15 is a plan view of a traverse unit of the yarn winding apparatus.
Figure 25:
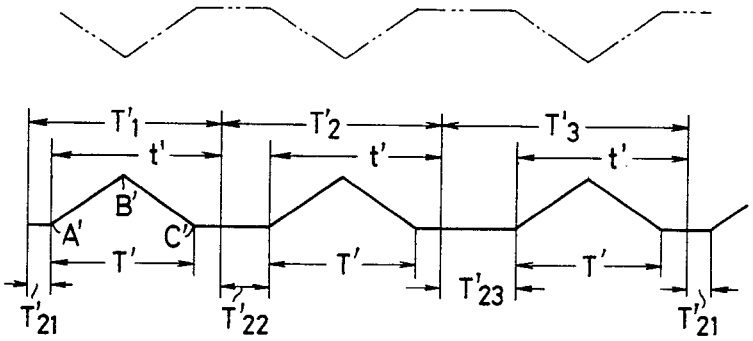
FIG. 25 is a diagram showing the relationship between a traverse width and time.

It is now assumed that the cam roller 106 is held against the cam 101 at a position A between the minimum-radius portion 1*a* and the other portion of the cam 101 (the position A corresponds to a point A in FIG. 25). When the cam shaft 102 rotates counterclockwise in FIG. 14, the cam 101 rotates therewith to cause the cam roller 106 to turn the L-shaped arm 104 counterclockwise. The connecting rod 107 is displaced in the direction of the arrow B in FIG. 14 to turn the cam plate 109 counterclockwise from the dot-and-dash-line position as illustrated in FIG. 15. The traverse guide 113 which is reciprocably guided in the groove 110 in the cam plate 109 and fitted in the traverse guide 112 in the traverse drum 111 is now subjected at its distal end to a progressively decreasing traversing motion. When the cam roller 106 contacts a point B on the cam 101 as shown in FIG. 14, the cam plate 109 is brought to the position shown in FIG. 15, whereupon the distal end of the traverse guide 113 moves in a minimum traverse width (at a point B in FIG. 25). Continued counterclockwise rotation of the cam 101 causes the L-shaped arm 104 to turn counterclockwise to displace the connecting rod 107 in a direction opposite to that of the arrow B (FIG. 14), thus bringing the cam plate 109 from the solid-line position to the dot-and-dash-line position in FIG. 15. When the roller cam 106 reaches a point C on the cam 101 (where the radius is minimum), the cam plate 109 assumes the solid-line position and the traverse width is maximum (at a point C in FIG. 25). At this time, the switch cam 122 engages the switch LS to turn it on. When the switch LS is closed, a clutch relay CR (FIG. 26) is turned off. Therefore, the clutch 123 is disconnected to prevent the motor 124 from driving the cam shaft 102.

Figure 26:
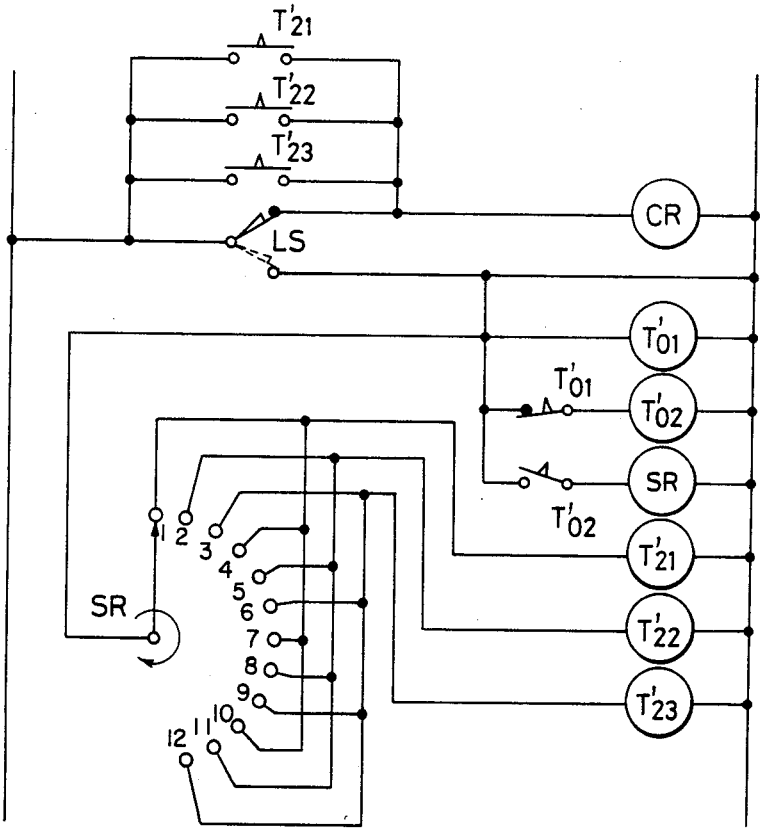
FIG. 26 is a wiring diagram showing electrical connections between components of the apparatus.

When the switch LS is shifted to the dotted-line position in FIG. 26, a relay T'02 is energized to close a contact T'02 for energizing a relay SR, which has its movable contact shifted from a contact 1 to a contact 2, whereupon a timer relay T'22 is energized. A predetermined time after the relay T'02 has been energized, a relay T'01 is energized to open a b contact T'01, causing the relay T'02 to open the a contact T'02. Thus, the movable contact of the stepping relay SR is shifted one step from the contact 1 to the contact 2.

Upon elapse of the time set by the timer T'22, it is operated to close its contact T'22 for energizing the clutch relay CR, whereupon the clutch 113 is connected again to enable the cam shaft 102 to start rotating, for thereby effecting creeping in response to rotation of the cam 101.

When the cam shaft 102 makes one revolution, the limit switch LS is actuated again to repeat the foregoing operation. Then, the movable contact of the stepping relay SR is shifted from the contact 2 to a contact 3 for energizing a timer 23. The timer T'21, T'22, and T'23 are differently set to provide respective timer periods T'21, T'22, and T'23 (T'21<T'22<T'23) as shown in FIG. 25.

The timers may be provided as many as desired, and the timer periods may be selected at random.

Instead of the timers, a microcomputer may be employed to select from a table of random numbers a time period for which the clutch can be disconnected, and the clutch relay can be energized after that time period.

With the method of this embodiment, as described above, time periods set in a plurality of timers are selected to cause the traverse guide to traverse a package in the maximum traverse width while the package is being wound up.

Conventionally, an interval of time in which creeping stops remains fixed until the package is wound up once the interval of time has been selected. However, this method allows such a creeping stop interval to be changed while the package is being would up by selecting desired creeping stop intervals, with the consequence that the yarn can be wound at the edges of the package at a uniform density.

What is claimed is:

1. A method of winding a yarn on a package, comprising the steps of:

(a) taking out a loose end of a yarn from a yarn supply and fixing the loose end to an empty package, the empty package having a width along an axis of rotation, thereafter maintaining a substantially uniform tension on the yarn throughout the subsequent steps;

(b) rotating the package about its axis of rotation so as to wind the yarn therearound, and continuing the rotation throughout the following steps:

(c) simultaneously, uniformly traversing the yarn across the width of the package from its point of attachment to the package to a first traverse limit corresponding to a first end of the package;

(d) reversing the direction of traverse of the yarn and uniformly traversing the yarn from the first limit of traverse of the yarn to a second limit of traverse of the yarn corresponding to a second end of a package;

(e) reversing the direction of traverse of the yarn and uniformly traversing the yarn from the second limit of traverse to the first limit of traverse;

(f) continuously sensing the radius of the package to establish when a full package has been formed, and when a full package is sensed, proceeding to step (j);

(g) progressively reducing the first and the second limits of traverse of the yarn so as to produce tapering ends on the package;

(h) repetitively performing steps (d) through (g) while further reducing the extent of traverse of the yarn by a creeping ratio, $\alpha$, defined by:

$$\alpha = t/(T+t)$$

where t is a time during which the traverse of the yarn is reduced to be less than the extent between the first and second traverse limits, and where T is a time during which the traverse of the yarn is at its full extent between the first and the second traverse limits, the creeping ratio being initially established to be significantly less than 1.0;

(i) progressively increasing the creeping ratio $\alpha$ to asymptotically approach 1.0 as the winding process proceeds; and (j) stopping the winding on reaching a condition of a fully wound package, removing the fully wound package, and introducing a fresh empty package.

2. A method of winding a yarn on a package as claimed in claim 1, further comprising a step of measuring an angle of inclination of a cradle arm supporting the axis of the package with respect to a package driving roller and progressively increasing said creeping ratio in response to the measured angle of inclination.

3. An apparatus for winding a running yarn on an empty package to form a fully wound package, the package having a first end, a second end, a circumference, and an axis of rotation through the first and second ends, the apparatus comprising:

a frame;

means, affixed to the frame, for rotating the package about the axis of rotation;

means, rotatably affixed to the frame, for supporting the package on its axis of rotation, said means being adapted to displace the axis of rotation of the package, in a parallel relationship, through an angle so as to maintain the circumference of the package substantially tangent with a path of travel of the yarn;

a traverse drum, rotatably supported on an axis held by the frame to be substantially parallel with the axis of rotation of the package, said traverse drum having a traverse groove formed in its outer circumference;

means for rotating the traverse drum about its axis;

a cam plate, pivotably supported from the frame in a spaced apart relationship from the outer circumference of the traverse drum, said cam plate having a longitudinal groove formed in a surface of the cam plate proximate to the traverse drum;

a traverse guide, having a substantially L-shaped configuration formed of a first arm and a second arm, said first arm including means, disposed at a distal end of said first arm, for guiding the yarn, said traverse guide being disposed between the traverse drum and the cam plate;

a first shaft affixed to a first surface of the trasverse guide substantially at the intersection of the first and second arms thereof, said first shaft extending so as to fit into and travel along the traverse groove of the traverse drum;

said traverse groove being configured so as to guide the first shaft from one end of the traverse drum to the other and the reverse, in a reciprocating manner, as the traverse drum is rotated;

a second shaft, affixed to the distal end of the second arm of the traverse guide and extending from a second surface thereof, opposed to the first surface thereof, so as to fit into and travel along the longitudinal groove of the cam plate; and means for pivoting the cam plate about its support, in response to a change in radius of the package and in response to a predetermined pattern of change, in a selectable manner, so as to controllably change the alignment of said longitudinal groove with respect to the axis of rotation of said traverse drum, thereby controllably changing the width of the package spanned by the distal end of the first arm of the traverse guide as the traverse drum is rotated;

whereby, rises of yarn occuring as a result of repeated winding during reversal of the direction of traversing the yarn may be selectably positionally staggered with respect to each other along the width of the package.

4. An apparatus as claimed in claim 3, wherein said means for controllably pivoting said cam plate about its support comprises:

a substantially Y-shaped arm having a first arm member, a second arm member, and a third arm member, intersecting to form the Y-shape, said Y-shaped arm being rotatably supported on a third shaft, affixed to said frame, through a point substantially at the intersection of its first, second, and third arm members;

an angular arm having a first arm member and a second arm member, said angular arm being rotatably supported substantially at an intersection of its first and second arm members by a pin affixed to the distal end of the first arm member of the Y-shaped arm;

a rod, attached between the distal end of the first arm member of the angular arm and said cam plate;

an arcuate cam, rigidly affixed to said means for supporting the package, and displacing therewith through a like angle;

a first cam roller rotatably affixed to the distal end of the second arm member of the angular arm;

means for urging said cam plate to pivot in a direction inducing the rod to pull the distal end of the first arm member of the angular arm to cause the angular arm to pivot about the pin so that the first cam roller maintains a rolling contact with the arcuate cam;

a plate cam, rigidly affixed to said means for supporting the package, and displacing therewith through a like angle;

an eccentric cam rotatably affixed to said frame;

means for controllably rotating the eccentric cam in response to a predetermined pattern of rotation;

a second cam roller, rotatably affixed to the distal end of the second arm member of the Y-shaped arm;

a third cam roller, rotatably affixed to the distal end of the third arm member of the Y-shaped arm; and means for urging the Y-shaped arm to pivot about said third shaft so as to bring the second cam roller into rolling contact with the plate cam when the plate cam is appropriately positioned by the angular position of the means supporting the package corresonding to an empty package, thereby maintaining the pin in a substantially fixed position relative to said frame; and said means subsequently urging, at a predetermined angular position of said means for supporting the package corresponding to a partially wound package whereat the plate cam no longer engages the second cam roller, the Y-shaped arm to pivot about said third shaft so as to bring the third cam roller into rolling contact with the eccentric cam, thereby enabling the position of the pin to be controllably varied in response to rotation of the eccentric cam.

5. An apparatus as claimed in claim 3, wherein said means for controllably pivoting said cam plate about its support comprises:

a substantially V-shaped arm having a first arm member and a second arm member intersecting to form the V-shape, and V-shaped arm being rotatably supported on a third shaft, affixed to said frame, through a point substantially at the intersection of its first and second arm members;

an angular arm having a first arm member and a second arm member, said angular arm being rotatably supported substantially at an intersection of its first and second arm members by a pin affixed to the distal end of the first arm member of the V-shaped arm;

a rod, attached between the distal end of the first arm member of the angular arm and said cam plate;

an arcuate cam, rigidly affixed to said means for supporting the package, and displacing therewith through a like angle;

a first cam roller rotatably affixed to the distal end of the second arm member of the angular arm;

means for urging said cam plate to pivot in a direction inducing the rod to pull the distal end of the first arm member of the angular arm to cause the angular arm to pivot about the pin so that the first cam roller maintains a rolling contact with the arcuate cam;

an eccentric cam, rotatably affixed to said frame;

means for controllably rotating the eccentric cam in response to a pre-determined pattern of rotation;

a second cam roller, rotatably affixed to the distal end of the second arm member of the V-shaped arm;

means for urging the V-shaped arm to pivot about the third shaft so as to bring the second cam roller into rolling contact with the eccentric cam, thereby enabling the position of the pin, relative to said frame, to be controllably varied in response to rotation of the eccentric cam; and means for limiting the motion of the rod, whereby, under a condition of starting a winding of yarn on an empty package and continuing until a predetermined amount of yarn has been wound on a partially full package, said cam plate is inhibited from fully pivoting under the urging of said means for urging said cam plate to pivot, which inhibits the rod from pulling the distal end of the first arm member of the angular arm a distance sufficient to bring the first cam roller into contact with the arcuate cam during a portion of each cycle of rotation of the eccentric cam.

6. An apparatus as claimed in claim 5, wherein said means for limiting the motion of said rod comprises:

a bell crank, rotatably supported by a fourth shaft affixed to said frame, said bell crank having a first arm and a second arm;

a roller, rotatably affixed to the distal end of the first arm of the bell crank;

an oblong hole formed in the distal end of the second arm of the bell crank;

a stopper cam, rotatably mounted on an eccentric shaft affixed to the frame, said stopper cam being disposed adjacent to the bell crank so as to contact a surface of said cam plate as said cam plate is pivoted by said means for urging said cam plate to pivot; and a pin affixed to the stopper cam and extended through the oblong hole in the bell crank;

whereby, as rotation of the eccentric cam pivots the V-shaped arm about the third shaft, thereby displacing the position of the pin affixed to the distal end of the first arm member of the V-shaped arm, the first cam roller affixed to the distal end of the second arm member of the angular arm is brought into contact with the arcuate cam, which causes the angular arm to pivot about the pin affixed to the distal end of the first arm member of the V-shaped arm, thereby pulling the rod to pivot said cam plate counter to the means for urging said cam plate to pivot until said cam plate contacts the roller affixed to the distal end of the first arm of the bell crank, which pivots the bell crank about the fourth shaft causing the stopper cam to be pivoted about its eccentric shaft by a rotational displacement of the oblong hole in the distal end of the second arm of the bell crank acting on the pin therethrough affixed to the stopper cam; and whereby, as said means for urging said cam plate to pivot enables said cam plate to again contact the stopper cam, a differing degree of pivoting of the cam plate is allowed by the stopper cam.

7. A method for winding a yarn on a rotating package, comprising the steps of:

(a) traversing the yarn laterally along the rotating package during the winding operation, the traversing being between progressively decreasing creeping limits, each traverse producing a yarn rise substantially at the point of reversal of yarn traversing, and continuing such traversing in a reciprocating manner throughout the performance of the subsequent steps;

(b) establishing a plurality of secondary yarn traversing patterns, each having at least one point where the speed of traversing of the yarn changes, said at least one point being other than a traverse reversing point, said at least one point providing a yarn rise on a change to a lesser yarn traversing speed and providing a less dense winding on a change to a greater yarn traversing speed;

(c) establishing a plurality of rates of change of yarn traversing speed, each capable of being applied at each of said at least one point where the speed of traversing of the yarn changes;

(d) aperiodically superimposing at least one of said plurality of secondary yarn traversing patterns and at least one of said plurality of rates of change of yarn traversing speed on the traversing of the yarn; and (e) repetitively aperiodically changing the yarn traversing pattern and the rate of change of yarn traversing speed among the respective pluralities of patterns and rates of change of yarn traversing speed in a manner adapted to controllably stagger the yarn rises and the regions of lesser density winding with respect to each other.

8. A method of winding a yarn on a rotating package in a twisting frame, comprising the steps of:

(a) traversing the yarn from one end of the package to the other, and the reverse, repetitively reversing the direction of traverse at each end of the package, throughout the performance of the subsequent steps; p1 (b) establishing a plurality of increasing intervals of time, which may be retained in selectable timers;

(c) progressively reducing the limits of traversing of the yarn toward each end of the package, said progressive reduction of the limits of traversing extending for a preestablished time interval;

(d) stopping the progressive reduction of the limits of traversing for one of said plurality of increasing intervals of time, allowing repetitive traversing of the yarn at the maximum yarn traversing limits during said time interval;

(e) repeating steps (c) and (d), successively selecting each of said plurality of increasing intervals of time in increasing order, and successively adjusting the time interval during which the limits of traversing are progressively reduced such that a total time interval for each repetition of steps (c) and (d) remains constant.

9. An apparatus for winding a running yarn on a rotating empty package to form a full package, the package having a first end, a second end, a circumference, and an axis of rotation passing through the first and second ends, the apparatus comprising:

a frame;

means for rotatably supporting the package from said frame by its axis of rotation;

a traverse drum, rotatably supported on an axis of rotation held by the frame to be substantially parallel with the axis of rotation of the package, the traverse drum having a traverse groove formed in its outer circumference;

means for rotating the traverse drum about its axis of rotation;

a cam plate, pivotably supported from the frame in a spaced apart relationship from the outer circumference of the traverse drum, the cam plate having a longitudinal groove formed in a surface of the cam plate proximate to the traverse drum and extending substantially the extent of the axis of the traverse drum;

means for pivoting the cam plate about its support so as to maintain the longitudinal groove in the cam plate substantially in alignment with the axis of rotation of the traverse drum;

a traverse guide, having a substantially L-shaped configuration formed of a first arm member and a second arm member, said first arm member being adapted to guide the yarn to the package from the distal end of said first arm member, said traverse guide being disposed between the traverse drum and the cam plate;

a first shaft, affixed to a surface of the traverse guide substantially at the intersection of the first and second arm members thereof, the first shaft being adapted to extend into and travel along the traverse groove and the traverse drum;

said traverse groove being configured so as to guide the first shaft from one end of the traverse drum to the other end of the traverse drum and the reverse in a reciprocating motion, as the traverse drum is rotated;

a second shaft, affixed to the distal end of the second arm of the traverse guide on a side of the traverse guide opposed that to which said first shaft is affixed, said second shaft being adapted to extend into and travel along the longitudinal groove in the cam plate;

a cam, rotatably supported on a third shaft affixed to the frame, said cam having a minimum-radius portion;

means for controllably rotating said cam about the axis of the third shaft in response to a predetermined pattern of rotation;

a substantially L-shaped arm, having a first arm member and a second arm member, pivotably supported on a fourth shaft affixed to the frame, said fourth shaft passing through the L-shaped arm substantially at the intersection of the first and second arm members;

a cam roller rotatably affixed to the distal end of the first arm member of the L-shaped arm;

a rod pivotably supported on the distal end of the second arm member of the L-shaped arm and extending to a coupling affixed to an end of the cam plate; and means for urging the L-shaped arm to pivot about the fourth shaft such that the cam roller is maintained in rolling contact with the cam;

whereby, rotation of said cam induces the L-shaped arm to pivot about the fourth shaft, thereby pulling the rod counter to the means for pivoting the cam plate, which varies the alignment of the longitudinal groove of the cam plate so as to pivot the traverse guide about said first shaft so as to reduce the extent of traverse of the yarn during controlled portions of operation of winding yarn onto the package.

10. An apparatus as claimed in claim 9, further comprising:

a plurality of means for rotatably supporting a rotating package, each of said means supporting a separate rotating package;

a like plurality of traverse drums, each traverse drum having its own traverse groove;

a like plurality of cam plates, each cam plate having its own longitudinal groove;

a like plurality of means for pivoting the cam plates;

a like plurality of traverse guides, each having a first shaft affixed thereto engaging a respective one of said traverse grooves, and a second shaft affixed thereto engaging a respective one of said longitudinal grooves;

a like plurality of substantially L-shaped arms, each pivotably supported on a respective one of a like plurality of said fourth shafts, each of said L-shaped arms carrying a cam roller on a distal end of its first arm member and having a rod pivotably supported on the distal end of its second arm member, which rod is coupled to a corresponding one of said plurality of cam plates;

a like plurality of cams rotatably supported, in a spaced apart relationship, on a single third shaft affixed to the frame such that each of said plurality of cams engages a corresponding one of said plurality of cam rollers;

a control unit providing a time sequence of driving pulses; and a stepping motor adapted to rotate the plurality of cams in response to the time sequence of driving pulses from the control unit.

11. An apparatus as claimed in claim 10, further comprising:

a switch cam supported on said third shaft and rotating with said plurality of cams supported thereon;

a switch, disposed to be actuated and deactuated by the switch cam;

a clutch mounted on said third shaft, said clutch being actuated by the switch to disengage said stepping motor from said third shaft when the cams are rotated to present their respective minimum-radius portions into contact with their respective cam rollers affixed to the first arm member of their respective L-shaped arms; and switching means for deactuating the clutch after the passage of a selectable predetermined time interval after the clutch has disengaged the stepping motor from the third shaft, thereby engaging the clutch with the third shaft to continue rotation of the third shaft and its affixed cams.

* * * * *